United States Patent [19]

Cocks et al.

[11] Patent Number: 5,036,243

[45] Date of Patent: Jul. 30, 1991

[54] GLASS PLATE ILLUMINATION DEVICE SIGN WITH INTEGRAL ELECTRODES OF PARTICULAR THERMAL RESISTANCE

[76] Inventors: Franklin H. Cocks, 5 Learned Pl., Durham, N.C. 27705; Peter W. Farner, 3315 Lorraine, Kalamazoo, Mich. 49008

[21] Appl. No.: 452,204

[22] Filed: Dec. 18, 1989

[51] Int. Cl.[5] ..... H01J 17/20; G09F 13/26

[52] U.S. Cl. ..... 313/39; 313/515; 313/577; 313/47; 40/545; 362/812

[58] Field of Search ..... 313/513, 515, 568, 576, 313/572, 573, 574, 577, 39, 47, 39, 47; 362/812; 40/545, 541

[56] References Cited

U.S. PATENT DOCUMENTS

| | | | |
|---|---|---|---|
| 2,018,874 | 10/1935 | Reitherman et al. | 313/515 |
| 2,253,441 | 8/1941 | McCauley | 313/515 |
| 2,302,667 | 11/1942 | Duncan | 313/515 |
| 2,448,937 | 9/1948 | Walter | 313/515 |
| 3,908,252 | 9/1975 | Willems | 313/631 |
| 4,153,861 | 5/1979 | Warner et al. | 313/594 |
| 4,584,501 | 4/1986 | Cocks | 313/493 |
| 4,703,574 | 11/1987 | Garjian | 40/545 |
| 4,839,555 | 5/1989 | O'Mahoney | 313/493 |
| 4,871,941 | 10/1989 | Dobashi et al. | 313/488 |
| 4,887,002 | 12/1989 | Dobashi et al. | 313/573 |
| 4,931,685 | 6/1990 | Dobashi et al. | 313/489 |

*Primary Examiner*—Donald J. Yusko
*Assistant Examiner*—John Giust

[57] ABSTRACT

An illumination device utilizes an electrical discharge through inert gas especially neon, argon, and mercury vapor or mixtures thereof, the electrical discharge being contained within two or more vitreous plates and confined within one or more channels within the vitreous plates. These channels, in combination with evacuation and gas filling means, provide one or more ionization chambers, the chambers being further provided with integral electrodes in combination with means for both thermally shielding the integral electrodes from the vitreous plates and for prevention of adhesion of the electrodes from the vitreous plates during the thermal sealing of the vitreous plates to form the ionization chamber or chambers. Special conditions for the relationship between the level of thermal shielding and the electrical power supplied to the electrode together with the design of the electrode assembly and electrode chamber and the use of infrared emissive coatings on the electrodes have been discovered which enable these electrodes to be contained integrally within the body of the illumination device rather than in chambers separate from, although attached to the body of the illumination device, and to be capable of continuous operation without causing cracking of the glass plates.

8 Claims, 2 Drawing Sheets

FIG. 2
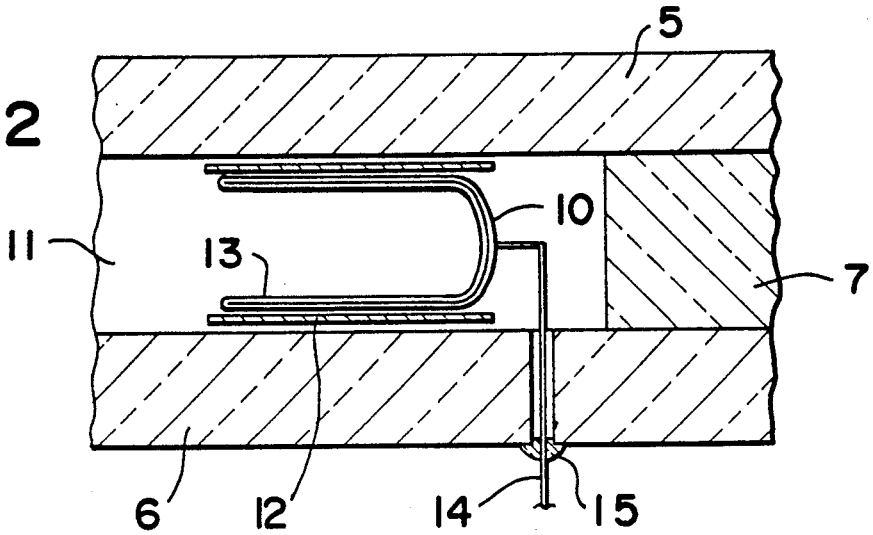
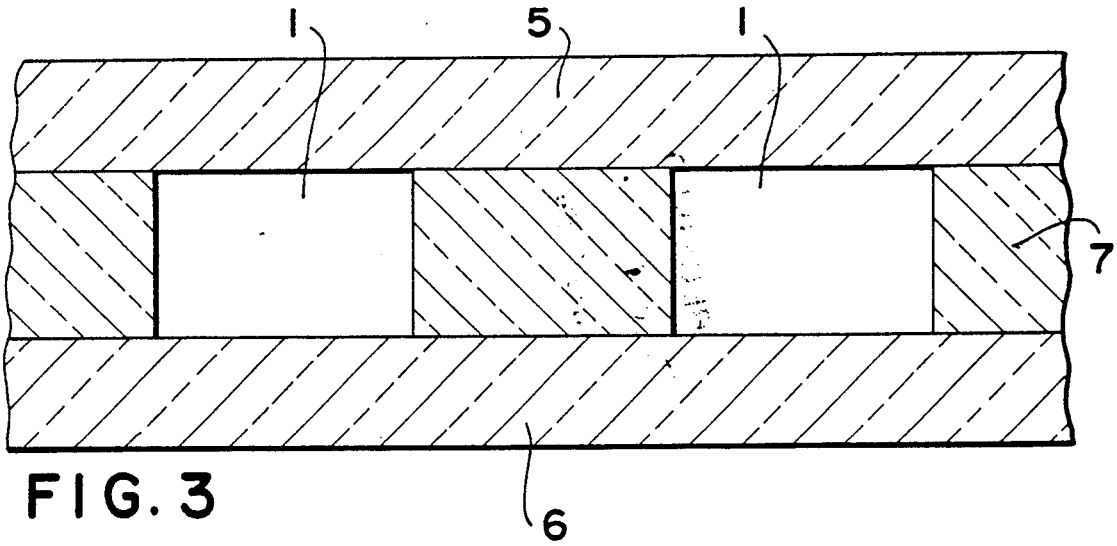
FIG. 3
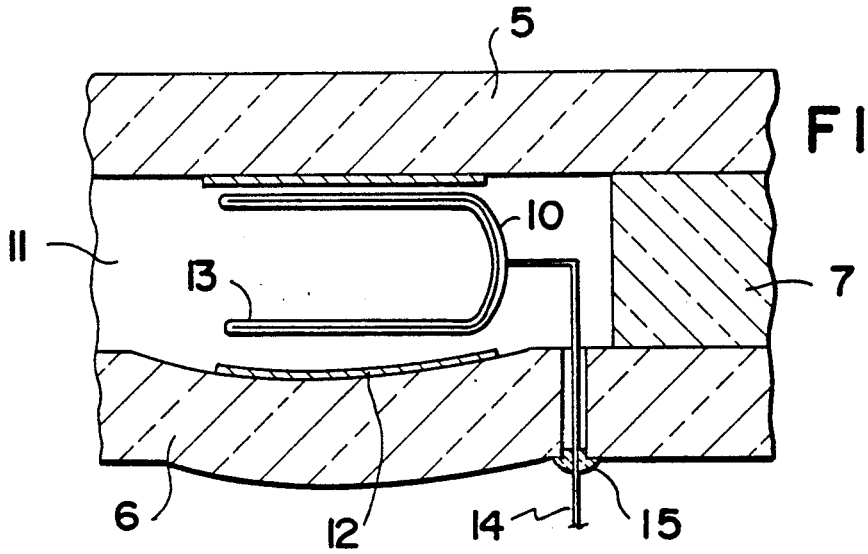
FIG. 4

GLASS PLATE ILLUMINATION DEVICE SIGN WITH INTEGRAL ELECTRODES OF PARTICULAR THERMAL RESISTANCE

SUMMARY OF THE INVENTION

This device provides a multifaceted lighting device comprising glass or other vitreous plates hermetically sealed together and provided with an interior channel or channels or any desired shape. The glass plates are transparent or translucent, and provision is made for the evaculation and filling of the channel or channels with inert gas or inert gas/mercury vapor mixtures. Most importantly, the device is provided with integral electrodes which are contained within the glass plates rather than in separate electrode tubulation compartments. This interior, integral containment of the electrodes is made possible through the use of insulating means which retard heat from passing by conduction to the glass from the electrodes and prevent adhesion of the metallic electrodes to the glass during fabrication, together with the use of infrared emissive coatings to increase the emission of radiant heat from the electrode especially along the open channel of the illumination device. These special conditions in combination with the design of the chamber itself are found to enable the electrodes to be integrally contained within the body of the glass plates and to be capable of continuous operation at high illumination intensity without resulting in the development of thermal stresses in the glass plates sufficient to produce cracking. Previous designs of plate glass neon signs have required that the electrodes be contained in electrode chambers which extend beyond the vitreous glass plates and which thus contain the electrodes outside the volume of the glass plates in order to provide the required cooling and to eliminate the thermal strain which integral containment of the electrodes would normally be expected to cause. The present invention eliminates the requirement of external electrode chambers and thus enables the production of plate-type illumination device which have greatly improved durability and robustness.

OBJECTS OF THE INVENTION

It is an object of the invention to provide a gas discharge illumination device having a plate configuration and of improved durability.

It is a further object of the invention to provide a gas discharge illumination device of flat plate configuration having an improved ease of manufacture.

It is yet another object of the invention to provide a plate glass illumination device having integral electrodes.

It is still a further object of the invention to provide a gas discharge illumination device which does not possess any electrode chambers external to the glass plates which form the body of the illumination device.

It is yet a further object of the invention to provide an integral, internal electrode chamber design which incorporates thermal insulation and infrared emissive coatings to enable high power electrodes to be contained entirely within the body of a plate glass illumination device and to be capable of continuous operation at high illumination intensity without causing cracking of the illumination device.

BACKGROUND OF THE INVENTION

Many luminous display devices utilize glowing gas discharges through inert gases such as neon or argon, together with fluorescent phosphor coatings and mercury vapor to provide a wide variety of colors. Traditionally, such devices have made use of thin walled gas tubes to contain the gas discharge, said glass tubes being bent to form the desired character shapes, and terminated with electrodes which are themselves contained within thin walled glass tubes such that the glow discharge tubes are hermetically sealed to the tubes containing the electrodes.

More recently, the use of channels cut into a glass plate, said plate then being sealed to form enclosed channels for the gas discharge have come into use, as taught in U.S. Pat. No. 4,584,501, which also shows the use of electrodes attached externally to the glass plates which contain the gas discharge channel. More recently still, Garjian in U.S. Pat. No. 4,703,574 teaches the use of a center feedthrough plate having termination bores to provide crossover paths to connect plate cavities in front and back plates to form a luminous sign. Garjian, however, also teaches the use of electrode cavities which extend beyond the confines of the plates to contain the electrodes though which electrical power is supplied to the luminous device.

More recently still, O'Mahoney in U.S. Pat. No. 4,839,555 teaches the use of adhesives to seal glass plates together to form a laminated lighting device. O'Mahoney too utilizes separate electrode chambers that are distinct from the body of the laminated display device to contain the electrodes that are necessary to provide the electrical gas discharge which provides the lighting of the device.

None of these disclosures, however, teach the use of electrodes that are internal to and integral with the body of the flat plate neon illumination device. Additionally, none of these disclosures reveal the specific conditions of electrode infrared emissivity and protective thermal resistance which allow the electrodes to be contained integrally within the body of the illumination device.

BRIEF DESCRIPTION OF THE DRAWINGS

FIG. 2 is a highly magnified sectional view taken upon line 2—2 in FIG. 1.

FIG. 3 is a magnified sectional view taken upon line 3—3 in FIG. 1.

FIG. 4 is a highly magnified sectional view taken upon line 2—2 in FIG. 1, as modified to show bulging of the back plate of the electrode chamber.

DETAILED DESCRIPTION

Figure 1:
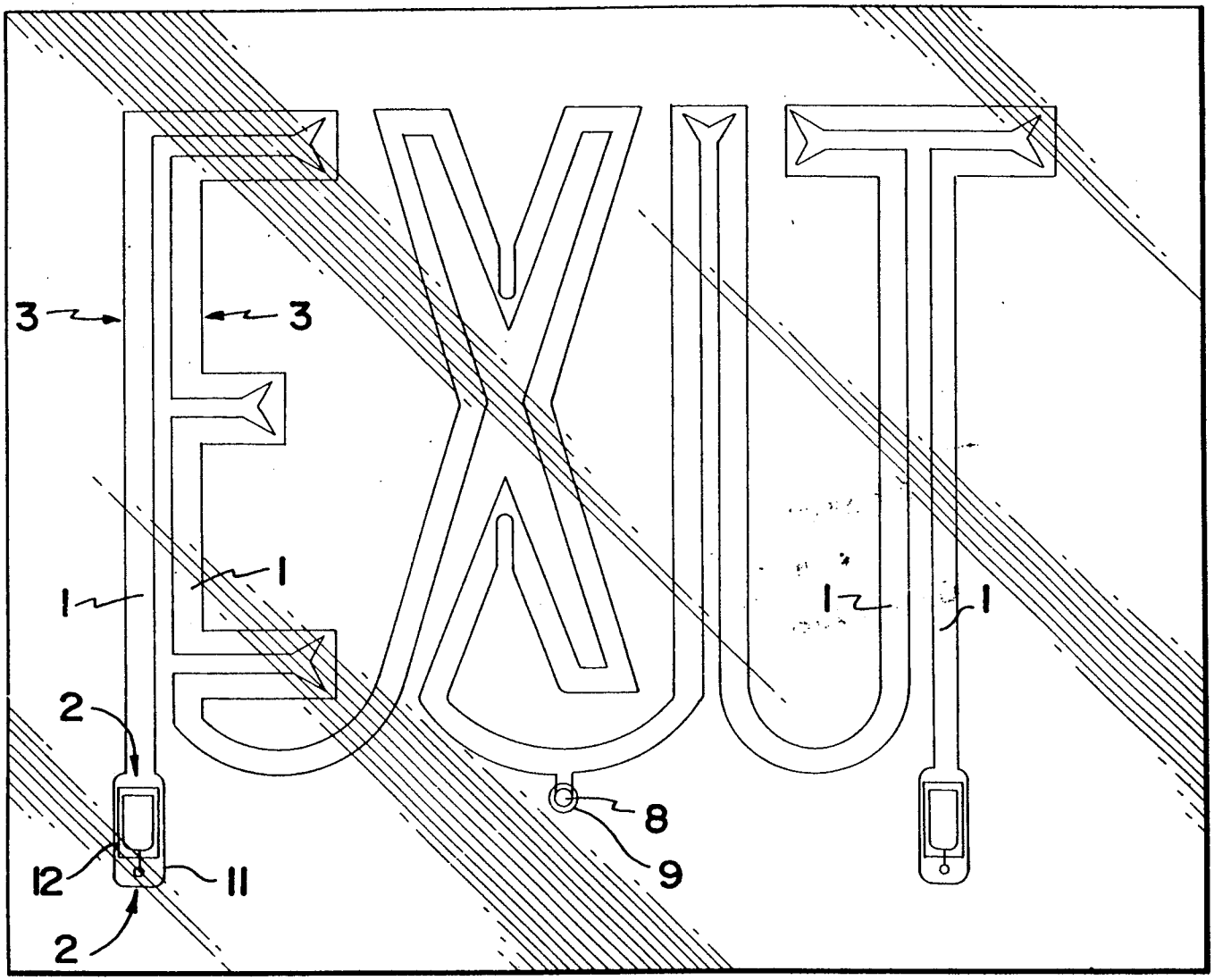
FIG. 1 is a front view of the device showing features of the preferred embodiments.

Referring now to the figures and in particular to FIG. 1, there is seen a front view of a flat plate luminous device. The shape of the electrical gas discharge is defined by the channel (1). As shown in FIG. 2 and FIG. 3, this channel is defined by a front plate (5) in combination with a back plate (6) which together enclose the cut away portions of a middle plate (7) to form the sealed channel region (1). This channel region is provided, as shown in FIG. 1, with an evacuation and gas filling tube (8) which is hermetically sealed to the back plate (6) by means of a glass frit (9). The electrodes (10) which supply power to the illumination device are contained in integral interior chambers (11). As shown in FIG. 2, these electrodes are further provided with thermal insulating means (12) which provent contact between the electrodes and the front and back plates as well as preventing contact with the middle plate. A coating (13) has enhanced infrared emissivity compared to bare metal. Electrical contact from the outside of the device to the electrode is provided by a lead-in wire (14) which is hermetically sealed to the back plate (6) by glass frit (15) or other means.

DESCRIPTION OF PREFERRED EMBODIMENTS

A preferred embodiment of this invention comprises a front glass plate (5) which is approximately 7/64 of an inch thick and which is composed of soda glass which contains at least ten percent soda by weight, together with lesser amounts of calcium oxide or potassium oxide or other oxides such that its thermal expansion coefficient is between 6 microinches/inch/degree centrigrade and 10 microinches/inch/degree centigrade, together with a middle glass plate (7) which is approximately 12/64 of an inch thick, and a back glass plate (6) which is approximately 8/64 of an inch thick. The total device thickness is thus less than one half inch. Said middle and back glass plates have compositions and thermal expansion coefficients close to those of said front glass plate. The channels (1) in said middle glass plate (7) may be cut by grinding, etching, sand blasting or other means. The evacuation and gas filling tube (8) is also composed of soda glass and is hermetically sealed to the back plate (6) by means of a glass frit such as Corning type 7575. Said glass tube (8) may itself be hermetically sealed shut by means of softening and pinching or by other means. Two, and not three, plates may be used if groves are ground in either the bottom or the top plate or both to form the channel or channels. The electrodes themselves are preferably stainless steel shells provided with wire leads, said wire leads being preferable made of Dumet or another suitable wire, said lead wire being hermetically sealed to said back plate by means of glass frit or powdered and then remelted soda glass. Said stainless steel shells are preferably at least ⅛ inch in outside diameter. It has now been discovered that insulating means in combination with electrode coatings of high infrared emissivity allow the electrodes to be operated continuously yet contained within the body of the illumination device. It has been found that the insulating means (12) must provide a thermal resistance R per unit area which is at least 5 degrees centigrade/watt/square centimeter. If the thickness of the glass is as given above, and the current supplied to the electrodes does not exceed 0.040 amperes at a voltage not greater than 18,000 volts nor less than 1000 volts and the gas pressure does not exceed 30 millitorr and is not less than 1 millitorr then the illumination device can be operated continuously without cracking of the illumination device. The production of a clearly visible illumination requires that the current not be less than one milliampere. If the total thickness of the plates which compose the device is increased by the use of thicker glass such that the thickness of the plates after hermetically sealing is greater than one inch, then it is found that the power levels of the device must be significantly reduce, even with the use of said insulating means. A preferred glass plate thickness is therefore less than one inch.

In a second preferred embodiment, the electrodes are coated with an infrared emissive coating that has preferably an infrared emissivity of at least 0.4, remembering that uncoated, bare metal can have an infrared emissivity as low as 0.04 or less. This coating can be produced by anodizing the electrode shells in warm sulfuric acid saturated with chromate-containing salts, such as sodium dichromate, or the infrared coating can be produced by vapor deposition or other means, the method by which the coating is produced not being essential to the invention. Indeed, by means of very special coatings it is technically possible to produce infrared immisivities as high as 0.98. In this embodiment, it is found that the operating illumination intensity of the device can be increased by the presence of the infrared coating beyond that found to be allowable with uncoated electrodes. While it is not known with certainty why the power levels may be increased, it is believed that the increased dissipation of heat along the length of the channel by the presence of a coating which radiates infrared heat strongly is responsible for the increased power level. It has been found that the use of infrared emmissive coatings produces devices of increased durability compared to the durability of gas discharge illumination devices produced using thermal insulation along. While it is not known why this is so, it is believed that the presence of the infrared emmissive coating decreases the temperature of the operating electrodes compared to that of uncoated electrodes and that this decrease in the temperature of the electrodes contributes to the increased operating lifetime of the device.

In a third preferred embodiment, the insulating means surrounding the electrode is a relatively thick but compressible foamed silicate that is of such a thickness that after sealing of the glass plates by heating, for example, the assembled device to a temperature above 1300 degrees Fahrenheit, the chamber in which the electrode is contained is bulged in an outward direction away from the body of the sign on at least one side. In this embodiment it has been surprisingly discovered that the operating power levels are increased even above those power levels which would be expected from the increased thickness of the insulation alone. While the exact reasons for this increase are not known with certainty it has has been observed using a polariscope that the maximum thermal stress produced in the glass by the operation of the electrode at a given power is greatly reduced when the chamber is bulged compared to that maximum stress found when the chamber is not bulged even when the thermal resistance per unit area of the thermal insulating means around the electrode is held essentially constant in both cases. After bulging the distortion of the walls of the electrode chamber is such that this chamber is no longer in the form of a rectangular trapezoid but is rather in the form of a trapezoid that has been bulged outwardly. After such bulging the resulting interior surface of the electrode chamber no longer consists of plane surfaces but rather comprises curved walls, and the sharp corner and edges of the electrode chamber are made less sharp by this bulging process and hence are not as effective as stress concentrators as they are when bulging does not occur. The resulting thermal stress concentrations which occur during operation are therefore not as great as they are in the case when the electrode chamber is not bulged. When the sharp corners and edges of the electrode chamber remain intact the presence of these sharp corners causes a high concentration of thermal stress. When the chamber is bulged these angles and corners are distorted and are not as effective at concentrating the thermal stress produced in the vitreous glass by the operation of the electrode. FIG. 4 shows the bulged back plate (6) of the electrode chamber (11).

We claim:

1. A gas-discharge illumination device comprising at least two glass plates said plates being hermetically sealed to provide at least one electrical gas discharge channel cut into at least one of the said glass plates said plates being hermetically sealed to provide at least one electrical gas discharge channel cut into at least one of the said glass plates, said channel being provided with evacuation and gas filling means and further supplied with at least two electrodes contained integrally within the body of said glass plates in electrode chambers which communicate with the said gas discharge channel, said electrodes being further supplied with thermal insulation means such that the the thermal resistance afforded to the flow of heat from the said electrodes to the glass plates per unit area is at least 5 degrees centrigrade/watt/square centimeter and provided further that the current supplied to the electrodes is less than 40 milliamperes but more than 1 milliampere and the voltage at which this current is supplied is less than 18,000 volts but more than 1000 volts and furthermore provided that the gas pressure in the electrical gas discharge channel is less than 35 millitorr but more than 1 millitorr.

2. An illumination device as described in claim 1 wherein the said electrodes are further provided with one or more infrared emissive coatings such that the average emissivity of the electrode is at least 0.4.

3. An illumination device as described in claim 1 wherein the thickness of the illumination device is less than one inch.

4. An illumination device as described in claim 1 wherein the thickness of the illumination device is less than one-half inch.

5. An illumination device as described in claim 1 wherein the said thermal insulation means is compressible and of such a thickness that after being hermetically sealed the said electrode chambers are bulged in an outward direction away from the body of the said illumination device on at least one side.

6. An illumination device as described in claim 5 wherein the said electrodes are are further provided with an infrared emissive coating having an infrared emissivity of at least 0.4.

7. An illumination device as described in claim 5 wherein the said glass plates are less than one inch thick.

8. An illumination device as described in claim 5 wherein the said glass plates are less than one-half inch thick.

* * * * *